US007700902B2

(12) United States Patent
Mock et al.

(10) Patent No.: US 7,700,902 B2
(45) Date of Patent: Apr. 20, 2010

(54) LOCKING ASSEMBLY FOR ROTARY SHAFTS

(75) Inventors: M. Robert Mock, Midway, UT (US); Mark Woodruff, Valencia, CA (US)

(73) Assignee: HR Textron, Inc., Santa Clarita, CA (US)

( * ) Notice: Subject to any disclaimer, the term of this patent is extended or adjusted under 35 U.S.C. 154(b) by 364 days.

(21) Appl. No.: 11/874,585

(22) Filed: Oct. 18, 2007

(65) Prior Publication Data

US 2009/0101752 A1 Apr. 23, 2009

(51) Int. Cl.
*F42B 15/01* (2006.01)
*H02K 7/10* (2006.01)

(52) U.S. Cl. ..... 244/3.24; 188/181 T; 192/56.1; 310/77; 310/75 R

(58) Field of Classification Search ..... 244/3.21, 244/3.24, 3.28, 3.29; 292/137, 163, 341.15, 292/144; 114/23, 24; 102/348, 384, 385, 102/388; 188/180, 181 R, 181 A, 181 C, 188/181 T; 192/55.1, 56.1; 464/37; 310/73, 310/93, 75 R, 41; 70/181–189
See application file for complete search history.

(56) References Cited

U.S. PATENT DOCUMENTS 2,180,516 A * 11/1939 Gehnrich ..... 292/341.15
2,629,156 A * 2/1953 Kamens et al. ..... 24/657
4,566,570 A * 1/1986 Geisthoff ..... 464/37
5,039,900 A * 8/1991 Nashiki et al. ..... 310/328
5,409,185 A 4/1995 Oldakowski
6,099,380 A 8/2000 Rasmussen
6,152,645 A 11/2000 Sanford
6,206,432 B1 3/2001 Kamiyama
6,250,584 B1 6/2001 Hsu et al.
6,352,217 B1 3/2002 Hsu et al.
6,640,720 B1 11/2003 Biserød
6,948,685 B2 9/2005 Hawthorne
7,011,661 B2 3/2006 Riedel et al.
7,175,131 B2 * 2/2007 Dodu et al. ..... 244/3.24
7,475,846 B2 * 1/2009 Schroeder ..... 244/3.26

FOREIGN PATENT DOCUMENTS

EP 0318359 A1 5/1989
GB 2265191 A * 9/1993
WO 2006021198 A1 3/2006
WO 2007089245 A2 8/2007

* cited by examiner

*Primary Examiner*—Michael R Mansen
*Assistant Examiner*—Joshua J Michener
(74) *Attorney, Agent, or Firm*—BainwoodHuang

(57) ABSTRACT

A locking assembly has a base and a rotary shaft which is capable of rotating relative to the base. The rotary shaft has a shaft body and a set of capture portions supported by the shaft body. The locking assembly further includes a set of detention mechanisms supported by the base. The set of detention mechanisms is arranged to (i) initially apply retention force to the set of capture portions to provide resistance against rotation of the rotary shaft from an initial angular position, and (ii) remove application of the retention force from the set of capture portions in response to an amount of rotational torque on the rotary shaft. The amount of rotational torque on the rotary shaft exceeds a predetermined threshold and is sufficient to substantially rotate the rotary shaft from the initial angular position.

14 Claims, 11 Drawing Sheets

LOCKING ASSEMBLY FOR ROTARY SHAFTS

BACKGROUND

In general, conventional guided munitions have movable fins which control their direction after launching of the guided munitions toward their targets. In some situations, such as under a wing of an aircraft prior to launch or during transportation, it is preferable to hold the fins rigidly in place. Such operation reduces wear, overstressing and the possibility of damage to the steering systems within the guided munitions while the guided munitions are carried by the aircraft for possible deployment or transported.

One conventional approach to holding the fins of guided munitions rigidly in place is to provide brakes which press against portions of the linkages to the fins. Electronic release circuits, which are typically separate from the guided munitions steering circuitry, then drive actuators to disengage or release the brakes at the time of deployment.

Another conventional approach to holding the fins of guided munitions rigidly in place involves the use of squibs (i.e., small explosive devices) or solenoids which are capable of quickly releasing hold of the fins. Here, bars or tabs initially engage the fins thus preventing unnecessary wear and possible damage to the control linkage prior to launch. Electronic release circuits, which are again separate from the guided munitions steering circuitry, then explode the squibs or activate the solenoids to disengage the bars or tabs and thus enabling the guidance system to freely control the direction of the fins.

SUMMARY

Unfortunately, there are deficiencies to the above-described conventional approaches to holding fins of guided munitions rigidly in place. In particular, each of the above-described conventional approaches requires extra electronic release circuitry which is separate from the existing steering circuitry that controls direction of the guided munitions after launch. Accordingly, such conventional approaches require extra electronic provisioning such as additional power sources (i.e., to test and power the actuator motors or solenoids, or to reliably explode the squibs), extra electrical connections from the aircraft to the guided munitions, and so on. Furthermore, this extra electronic release circuitry provides an additional level of complexity which is susceptible to malfunction.

In contrast to the above-described conventional approaches which require extra electronic release circuitry, various embodiments of the invention involve capture of a rotary shaft using a detention mechanism (e.g., spring-loaded pins resting within indents on the shaft). While the rotary shaft is in a non-operating state, the detention mechanism is capable of robustly and reliably holding the rotary shaft in a fixed position, i.e., a locked state. For the rotary shaft to unlock from the detention mechanism, the rotary shaft rotates until the detention mechanism lets go of the rotary shaft thus enabling free control of the rotary shaft.

In the context of guided munitions, the rotary shaft may be the rotor of an electric motor which is constructed and arranged to control orientation of a control surface after deployment or arming, i.e., which is part of the steering circuitry. Prior to deployment, the detention mechanism reliably holds the rotor of the electric motor in place to remove unnecessary wear and tear on the rotor and its connecting linkage. To unlock the rotor from an initial locked position, a user simply directs the motor to turn the rotor out of its locked position until the detention mechanism lets go of the rotor. At this point, the motor is then able to freely steer the control surface. Based on the above, it will be appreciated that there is no need to have separate electronic circuitry solely responsible for controlling the locking/unlocking feature. Rather, the same electric circuit, which steers the control surface after launch, can be used to control the locking/unlocking of the rotor.

One embodiment is directed to a locking assembly having a base and a rotary shaft which is capable of rotating relative to the base. The rotary shaft has a shaft body and a set of capture portions (e.g., indents) supported by the shaft body. The locking assembly further includes a set of detention mechanisms (e.g., pins) supported by the base. The set of detention mechanisms is arranged to (i) initially apply retention force to the set of capture portions to provide resistance against rotation of the rotary shaft from an initial angular position, and (ii) remove application of the retention force from the set of capture portions in response to an amount of rotational torque on the rotary shaft. The amount of rotational torque on the rotary shaft exceeds a predetermined threshold and is sufficient to substantially rotate the rotary shaft from the initial angular position.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the invention involve capture of a rotary shaft using a detention mechanism (e.g., spring-loaded pins resting within indents on the shaft). While the rotary shaft is in a non-operating state, the detention mechanism is capable of robustly and reliably holding the rotary shaft in a fixed position, i.e., a locked state. To unlock the rotary shaft from the detention mechanism, the rotary shaft rotates until the detention mechanism lets go of the rotary shaft. In the context of guided munitions, the rotary shaft may be the rotor of an electric motor which is constructed and arranged to control orientation of a control surface (e.g., a fin) after deployment or arming. Prior to deployment, the detention mechanism holds the rotor of the electric motor in place to prevent stresses on the control surface from overstressing or damaging the rotor and its connecting linkage. To unlock the rotor from an initial locked position, a user simply directs the motor to turn the rotor out of its locked position until the detention mechanism lets go of the rotor. The motor is then able to freely steer the control surface. Accordingly, it will be appreciated that there is no need to have separate electronic circuitry solely responsible for controlling the locking/unlocking feature. Rather, the same electric circuit which steers the control surface after launch can be used to control locking/unlocking of the rotor.

Figure 1:
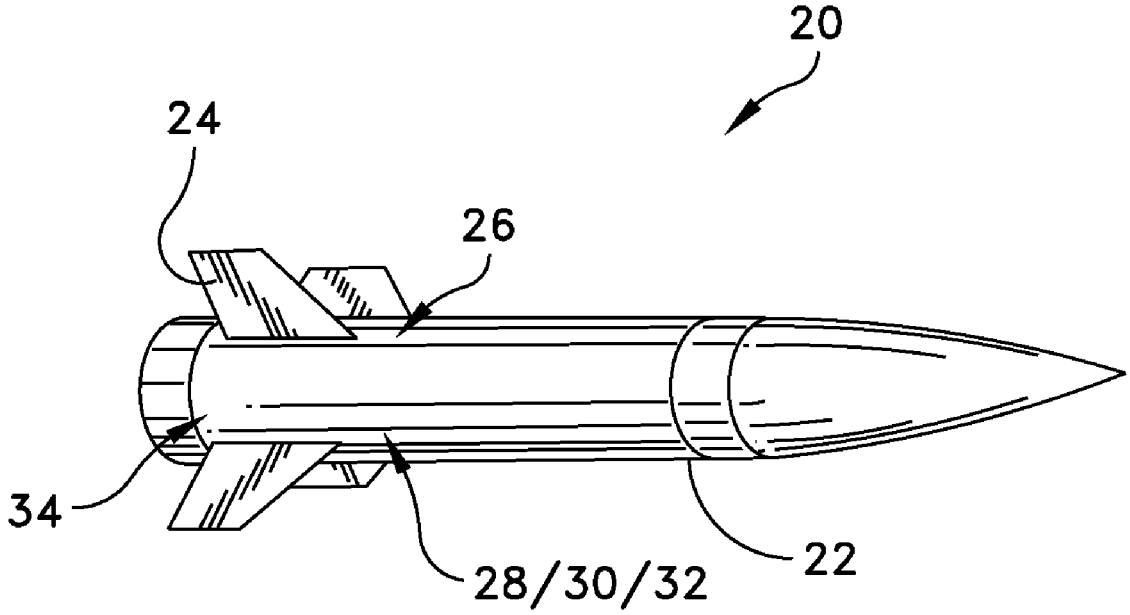
FIG. 1 is a perspective view of a guidable projectile having a set of improved locking assemblies.

FIG. 1 shows a guidable projectile 20 having a main projectile body 22, control surface members 24 (e.g., fins, flaps, rudders, etc.), and a guidance system 26 (shown generally by the arrow 26) to control movement of the control surface members 24. The guidance system 26 includes electronic circuitry 28, motors 30 and control linkage 32 for moving the control surface members 24 and thus guiding the projectile 20 after the projectile 20 is launched.

As will be explained in further detail shortly, the guidance system 26 includes locking assemblies 34 which are integrated with the rotary shafts of the motors 30 which link to the control surface members 24. The locking assemblies 34 are constructed and arranged to provide resistance to the rotary shafts prior to deployment to prevent turbulence in the environment from wearing out, weakening or possibly damaging the guidance system 26. However, once the locking assemblies 34 unlock the rotary shafts of the motors 30, the motors 30 are capable of steering the control surface members 24 and thus effectively controlling the trajectory of the projectile 20.

By way of example only, the guidable projectile 20 is shown in FIG. 1 as a guidable missile which is capable of affixing to the exterior of an aircraft. It should be understood that the guidable projectile 20 is capable of taking other forms in other contexts well. Such forms and contexts include a torpedo which can be guided while traveling through water, a guidable bomb which can be guided to a surface target after being dropped from the sky, and a rocket or other vehicle which can be steered using control surfaces, among others. Further details will now be provided with reference to FIGS. 2 through 5.

Figure 2:
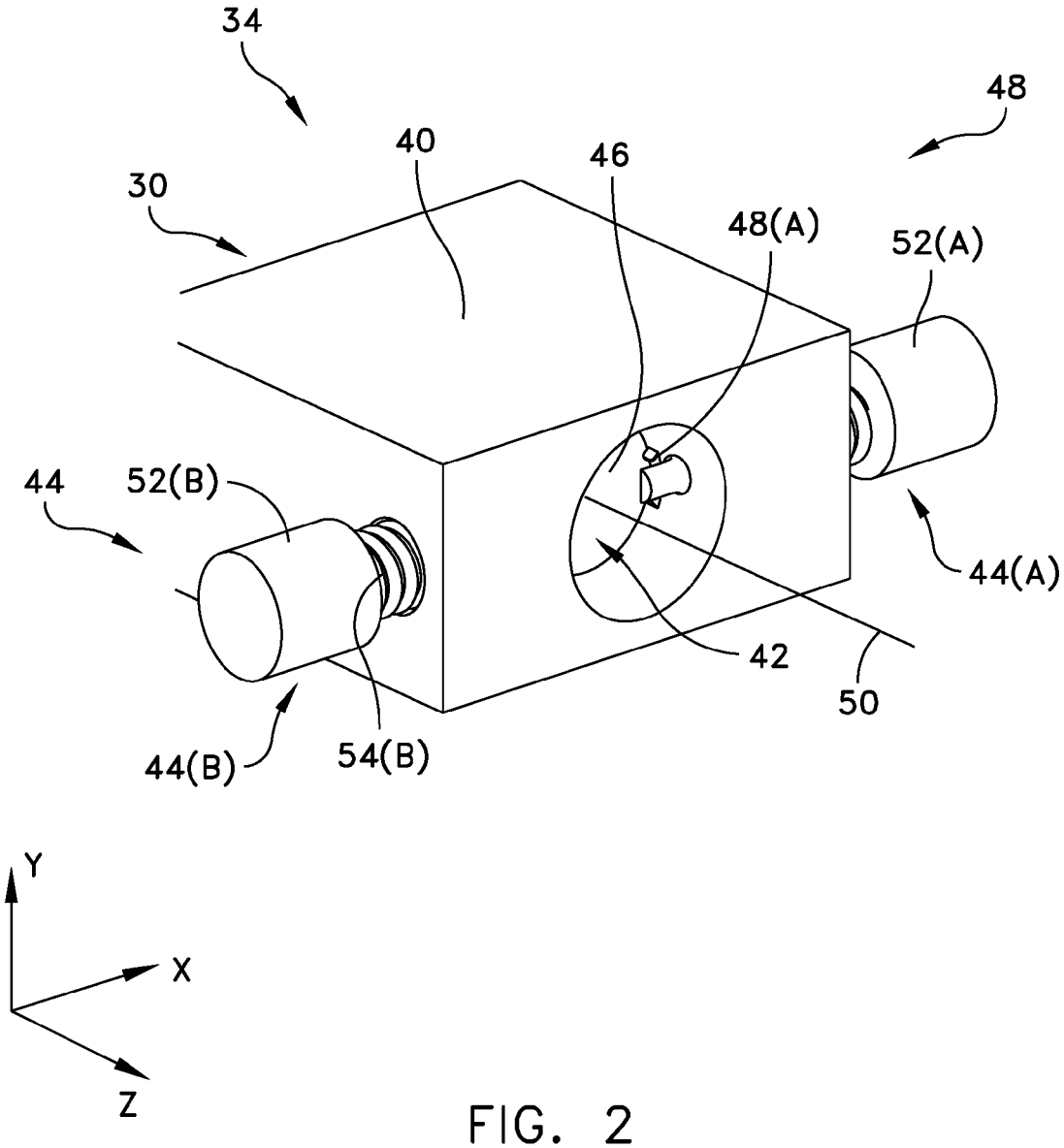
FIG. 2 is a general view of an improved locking assembly of the guidable projectile of FIG. 1.
Figure 3:
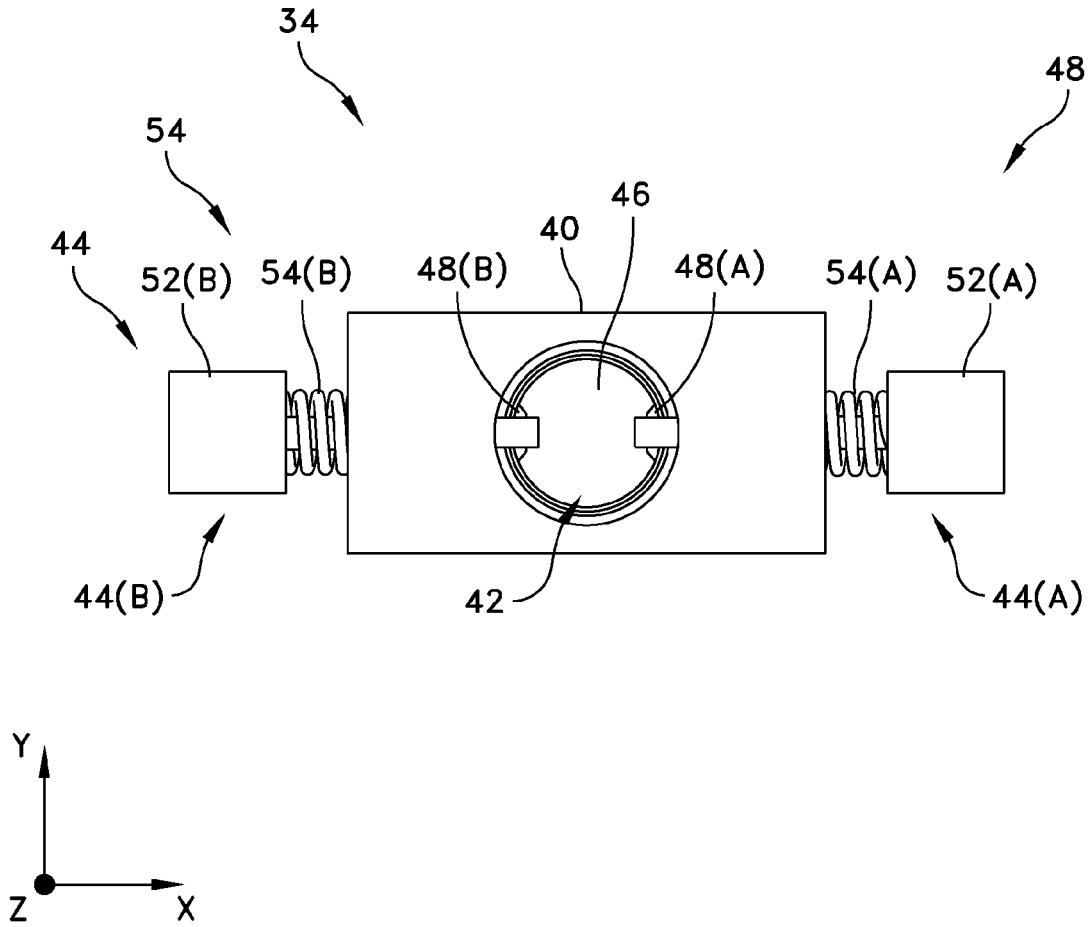
FIG. 3 is a bottom view of the improved locking assembly of FIG. 2 while in a locked state.
Figure 4:
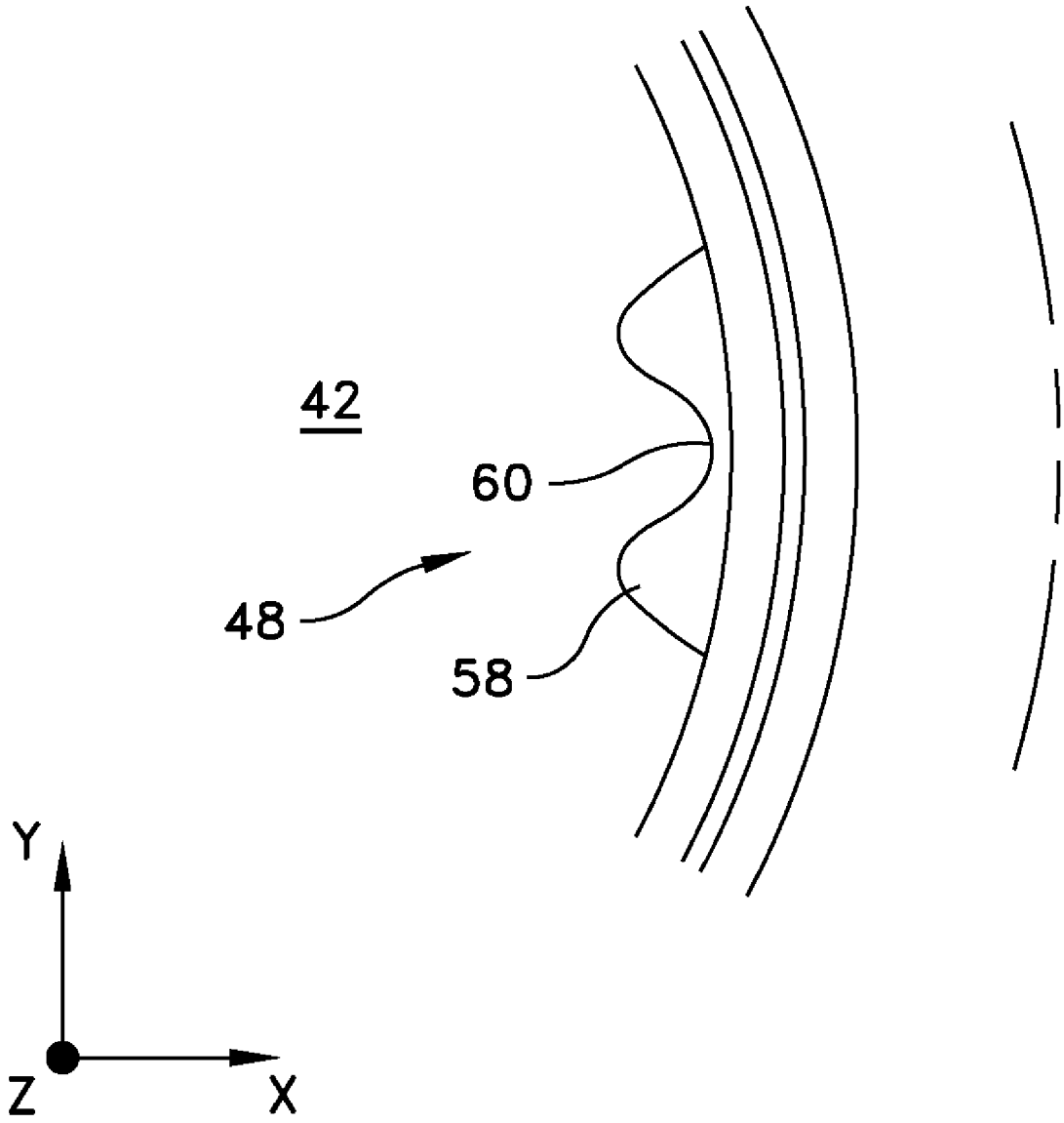
FIG. 4 is a detailed view of a particular feature of the improved locking assembly of FIG. 2.
Figure 5:
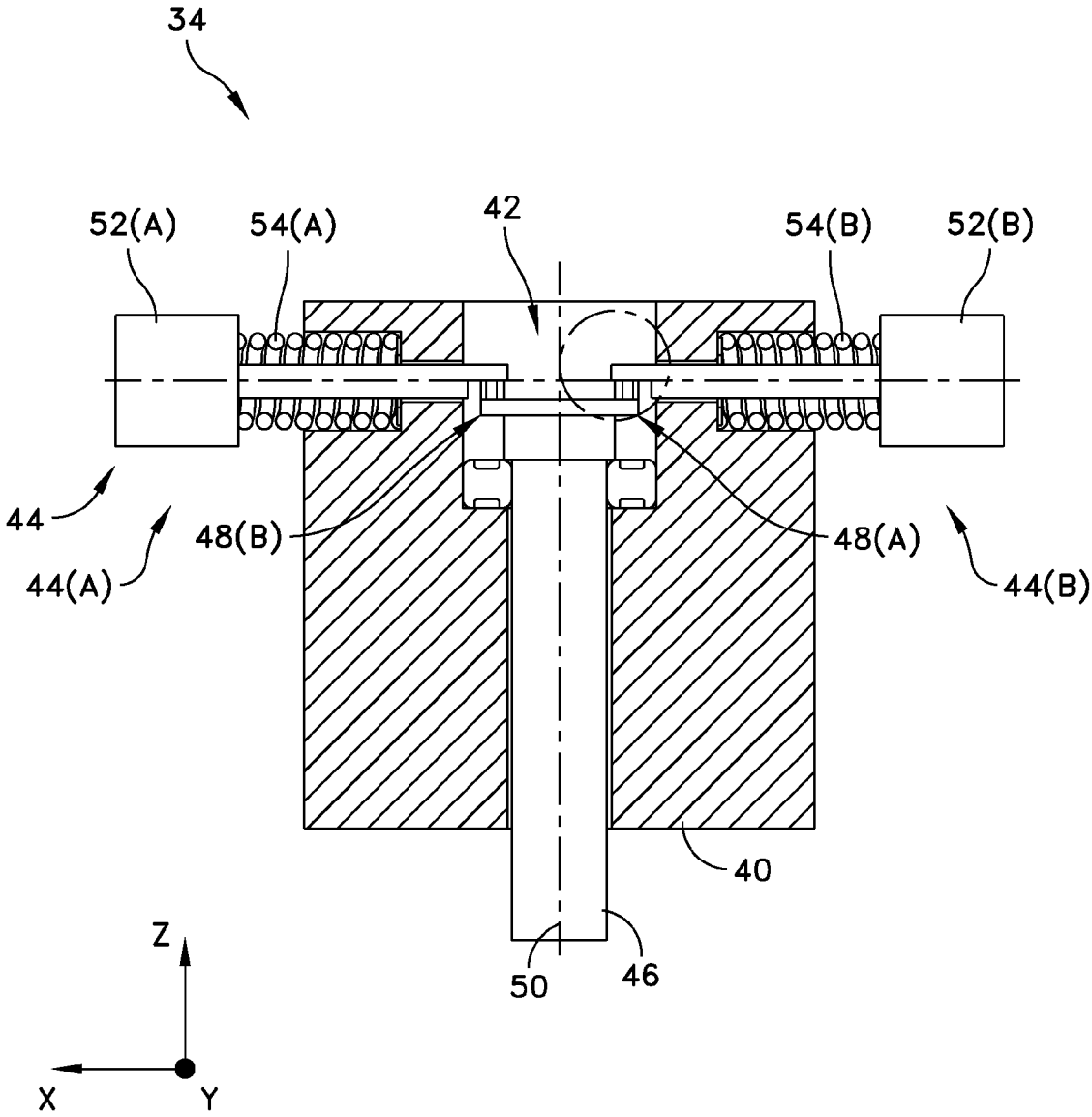
FIG. 5 is a cross-sectional side view of the improved locking assembly of FIG. 2.

FIGS. 2 through 5 illustrate various features of a locking assembly 34 while the locking assembly 34 resides in a locked state. FIG. 2 is a generalized view of the locking assembly 34. FIG. 3 is a bottom view of the locking assembly 34 showing an end of a rotary shaft of a motor 30 which is held substantially stationary while the locking assembly 34 resides in the locked state. FIG. 4 is a detailed view of a portion of the rotary shaft of the motor 30. FIG. 5 is a cross-sectional side view of the locking assembly 34.

As shown in FIGS. 2 through 5, the locking assembly 34 includes a base 40 which derives support from the main projectile body 22 (also see FIG. 1), a rotary shaft 42 of a motor 30 (FIG. 1), and a set of detention mechanisms 44. The rotary shaft 42 has a shaft body 46 (FIG. 5) and a set of capture portions 48(A), 48(B) (collectively capture portions 48) which are supported by the shaft body 46 at one of its ends. The rotary shaft 42 defines an axis of rotation 50 which is substantially parallel to the Z-axis in FIGS. 2 through 5.

The set of detention mechanisms 44 derive support from the base 40. Each detection mechanism 44 includes a retainer 52 and a spring 54. In particular, a detection mechanism 44(A), which corresponds to the capture portion 48(A), includes a retainer 52(A) and a spring 54(A). Similarly, a detection mechanism 44(B), which corresponds to the capture portion 48(B), includes a retainer 52(B) and a spring 54(B).

During operation, the detention mechanisms 44 initially engage with their corresponding capture portions 48 of the rotary shaft 42. That is, the detention mechanisms 44 initially apply retention force to the capture portions 48 to provide resistance against rotation of the rotary shaft 42 from an initial angular position as shown in FIGS. 2 and 3. To this end, the retainer 52(A) of the detention mechanism 44(A) engages with the corresponding capture portion 48(A), and the spring 54(A) continuously biases the retainer 52(A) in a radial direction from the center axis 50 (i.e., the positive X-axis). Similarly, the retainer 52(B) of the detention mechanism 44(B) engages with the corresponding capture portion 48(B), and the spring 54(B) continuously biases the retainer 52(B) in a radial direction from the center axis 50 (i.e., the negative X-axis).

While the rotary shaft 42 is in this initial angular position, the capture portions 48 are aligned with the detention mechanisms 44 (e.g., all along the X-axis) which evenly pull away in opposite directions to hold the rotary shaft 42 stationary in a reliable, well-balanced manner. In particular, the rotary shaft 42 remains substantially in place as long as the amount of torque applied to the rotary shaft 42 is under a predetermined threshold $T_L$ (e.g., 8 inch/lbs.).

To unlock the locking assembly 34, an external influence (e.g., operation of the motor 30 to turn the rotary shaft 42) moves the rotary shaft 42 so that the capture portions 48 escape from the detention mechanisms 44. This situation occurs when the amount of torque applied to the rotary shaft 42 exceeds the predetermined threshold $T_L$. When this occurs, the locking assembly 34 removes application of the retention force from the set of capture portions 48 thus enabling the rotary shaft 42 to be rotated freely.

As shown in FIG. 4, each capture portion 48 defines two lobes 58 and an indent 60 disposed between the two lobes 58. The contour of the lobes 58 and the indent 60 enables the capture portion 48 to reliably capture an end of a retainer 52 while the end of the retainer 52 is urged by its corresponding spring 54 toward the capture portion 48 to nestle the end of the retainer 52 as deeply into the indent 60 between the lobes 58 as possible.

Preferably, the indents 60 face toward each other and toward the central axis 50 (FIG. 3). The particular amount of torque and angular displacement required to effectuate escape of the capture portions 48 from the retainers 52 is easily controlled by the amount of spring force provided by the springs 54 and the particular shape of the lobes 58 and the indent 60. Further details will now be provided with reference to FIGS. 6 through 8.

Figure 6:
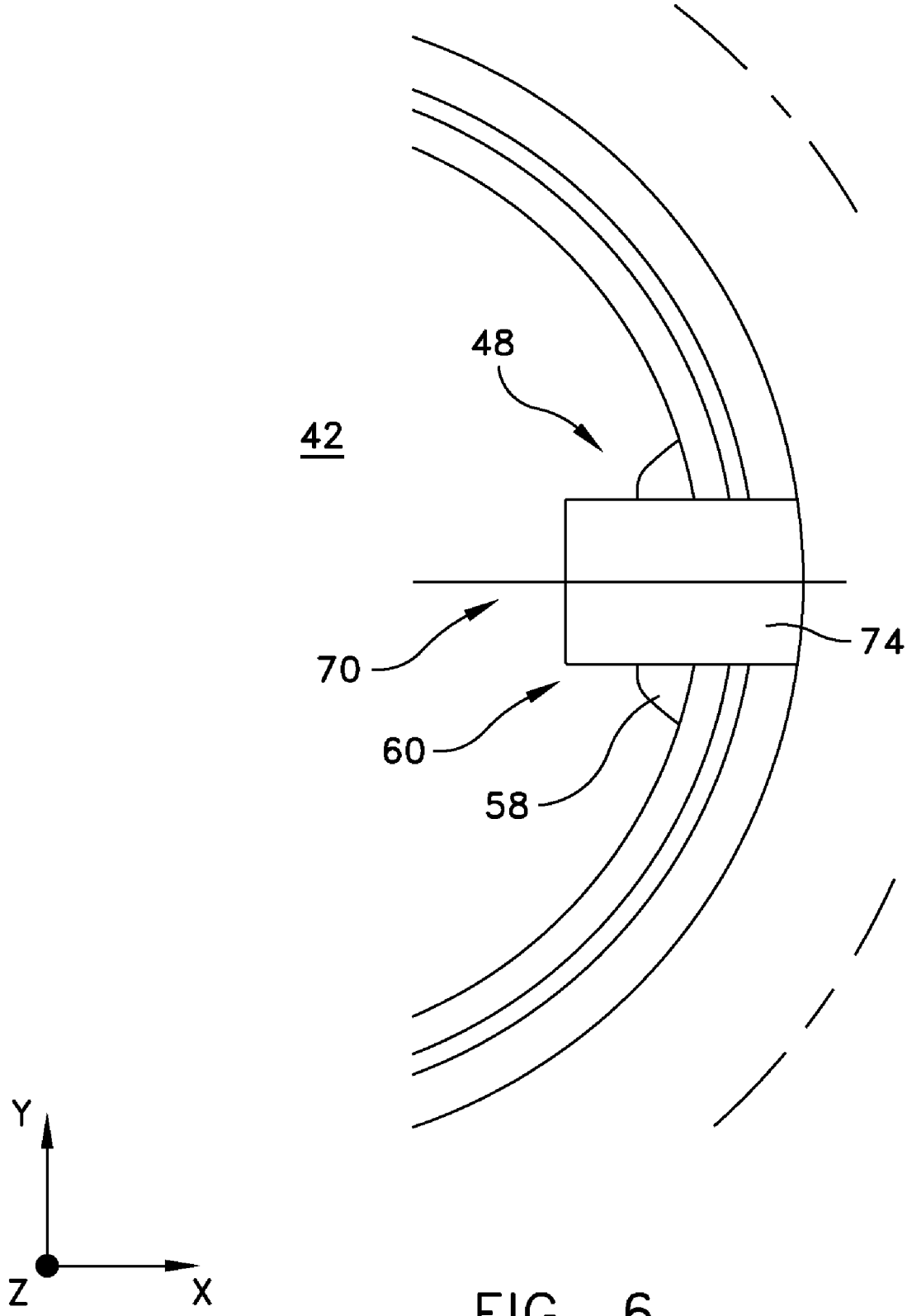
FIG. 6 is a detailed bottom view of a portion of the improved locking assembly of FIG. 2.
Figure 7:
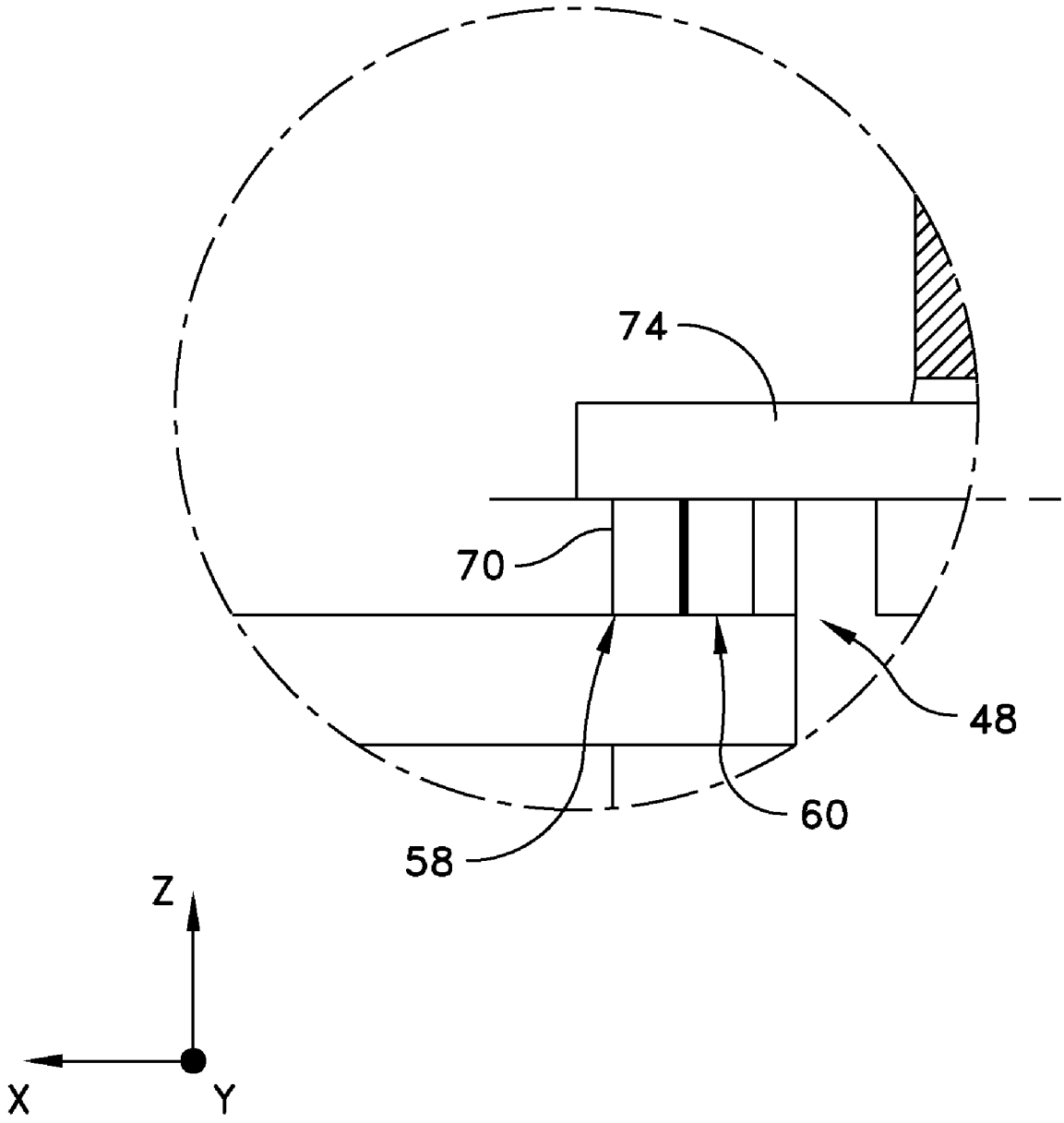
FIG. 7 is a detailed side view of the portion of the improved locking assembly of FIG. 2.
Figure 8:
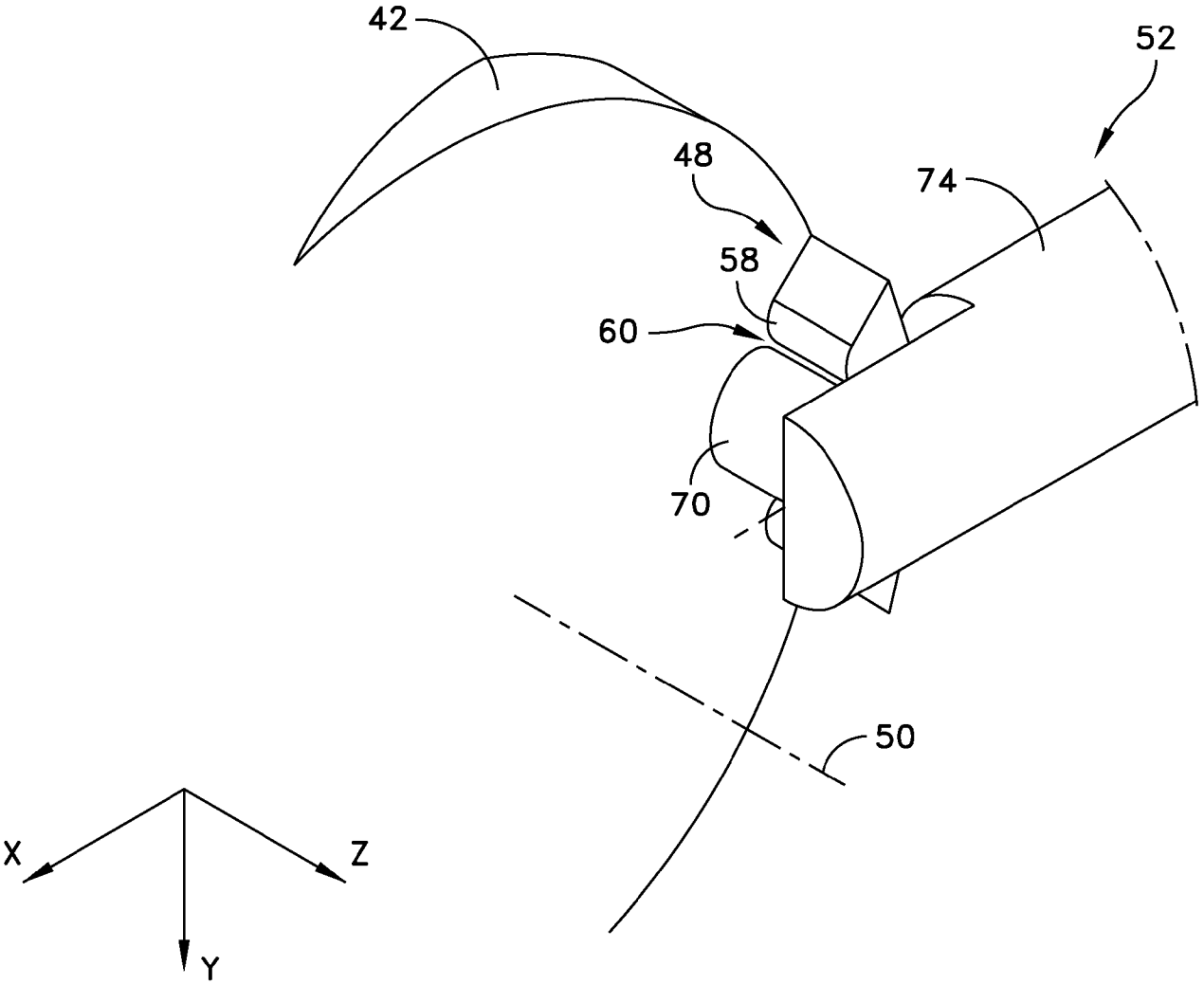
FIG. 8 is a perspective view of particular engagement features of the improved locking assembly of FIG. 2.
Figure 9:
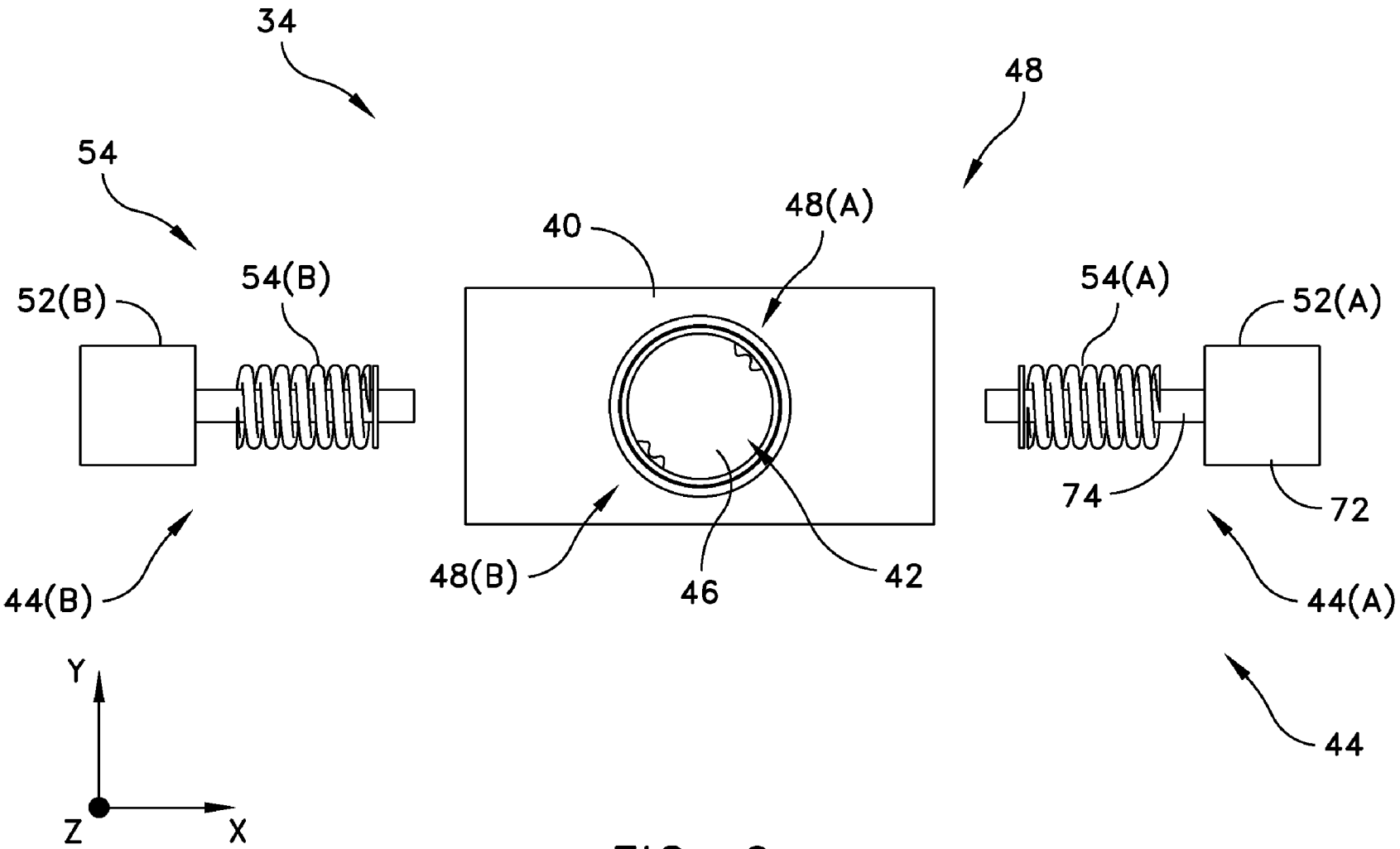
FIG. 9 is a bottom view of the improved locking assembly of FIG. 2 while in an unlocked state.

FIGS. 6 through 9 illustrate further capture/release features of the locking assembly 34. FIG. 6 is a detailed bottom view of part (see the circled area in FIG. 5) of the locking assembly 34 when a retainer 52 firmly engages the corresponding capture portion 48. FIG. 7 is a detailed side view of that part again when the retainer 52 firmly engages the corresponding capture portion 48. FIG. 8 is a perspective view of that part showing particular engagement features. FIG. 9 is a bottom view of the locking assembly 34 after the locking assembly 34 transitions from the locked state to the unlocked state.

Each retainer 52 includes a pin 70, a retainer body 72 and a neck 74 that interconnects the pin 70 with the retainer body 72. The spring 54 is illustrated as a compression spring which wraps around the neck 74 and derives leverage from the base 40 to bias the retainer body 72 outwardly from the central axis 50. As a result, the neck 74 controls positioning of the spring 54 and transfers the force, which is applied by the spring 54 to the retainer body 72, to the pin 70. Preferably, the pin 70 defines a surface which enables the pin 70 to rest within the indent 60 and to glide relatively smoothly between the indent 60 and the neighboring lobes 58 on a corresponding capture portion 48 (FIG. 4).

While the pin 70 resides against the indent 60 defined by the capture portion 48, the spring 54 is compressed. It should be understood that, to disengage the pin 70 from the indent 60, the spring 54 must be slightly further compressed to enable the pin 70 to move over one of the lobes 58 of the capture portion 48. For example, the retainer 52(A) must move in the negative X-direction (FIG. 3) to further compress the spring 54(A) for the pin 70 to move over a lobe 58 of the capture portion 48(A). Once the pin 70 passes over the lobe 58, the compressed spring 54 is able to expand and move the retainer 52(A) in the positive X-direction out of the base 40 so that there is no longer resistance on the rotary shaft 42. The retainer 52(B), the spring 54(B), and the capture portion 48(B) behave similarly but in the opposite direction.

At this point, it should be understood that the locking assembly 34 is well-suited for a variety of applications. In the context of the earlier-described guidable projectile 20, recall that the rotary shaft 42 constructed and arranged to control movement of a control surface member 24 such as a fin relative to the main projectile body 22 (also see FIG. 1). In these arrangements, the rotary shaft 42 is capable of being the shaft of a motor 30 which is under electronic control of the guidance system 26. For example, the base 40 (FIG. 2) may be the motor housing (e.g., the stator) or an extension of the motor housing, and the shaft body 46 may be the portion of the motor that rotates (e.g., the rotor) within the motor housing. The output of the motor 30 is set to be greater than the predetermined threshold $T_L$ (e.g., an output of at least 100 inch/lbs.). Accordingly, the motor 30 does not become overstressed when turning the rotary shaft 42 to unlock the rotary shaft 42 from the detention mechanisms 44 (also see FIG. 9). A similar arrangement preferably for each of the control surface members 24.

It should be further understood that the predetermined threshold $T_L$ does not need to be larger than the amount of external force endured by the control surface members 24. Rather, the linkage 32 (FIG. 1) between the rotary shaft 42 and the control surface member 24 is constructed and arranged to prevent the external forces on the control surface member 24 from inadvertently unlocking the locking assemblies 34 (e.g., using gear reduction). Further details will now be provided with reference to FIGS. 10 and 11.

Figure 10:
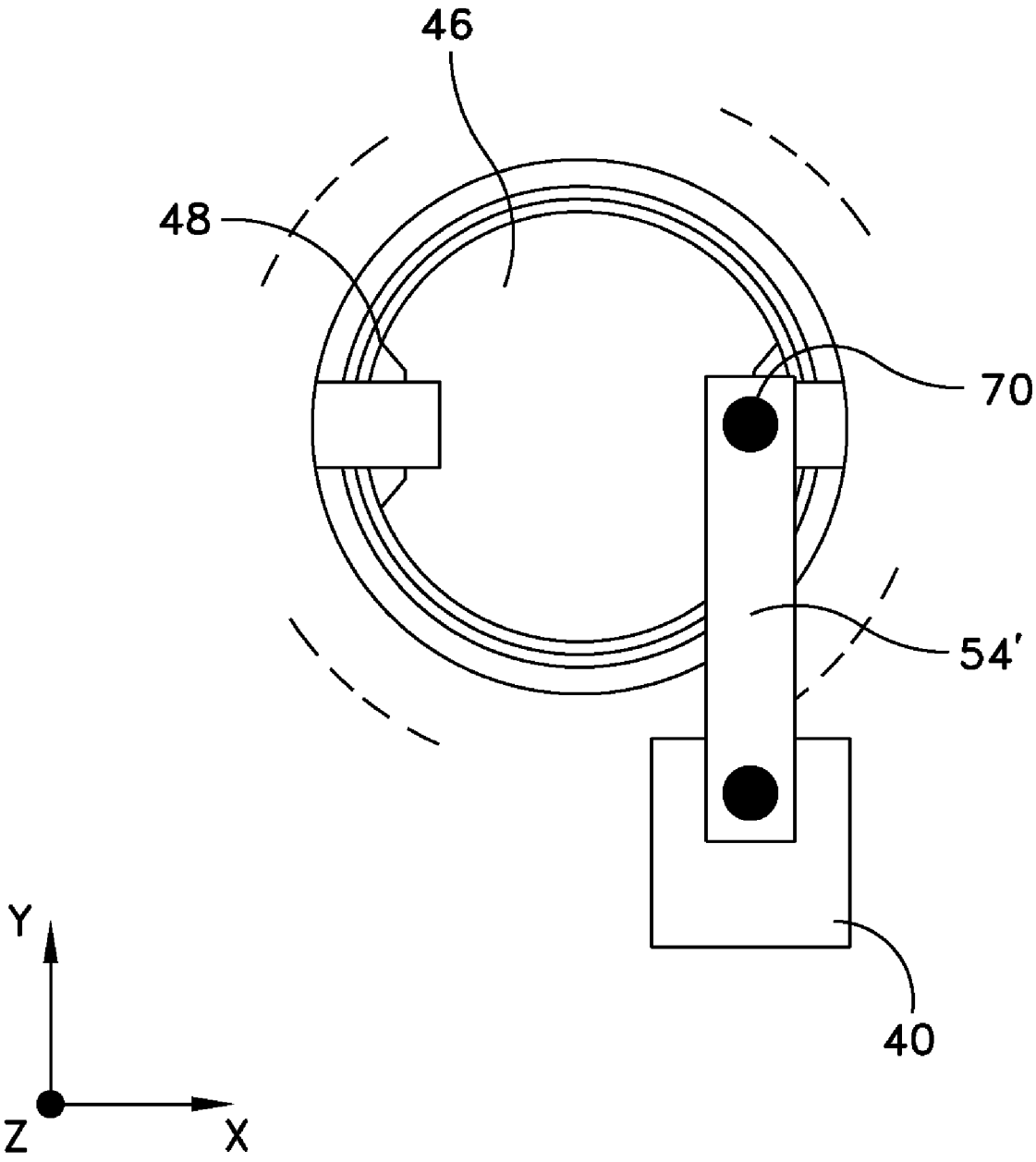
FIG. 10 is a bottom view of the improved locking assembly of FIG. 2 with an alternative spring mechanism.

FIG. 10 shows a configuration for the locking assembly 34 which is an alternative to that shown earlier (e.g., contrast with FIG. 7). In the configuration of FIG. 10, the locking assembly 34 includes a torsion spring 54' to bias the pin 70 rather than a compression spring 54.

Here, the torsion spring 54' is nevertheless constructed and arranged to robustly and reliably urge a retainer 52 so that the pin 70 of the retainer 52 applies retention force to a corresponding capture portion 48. Once the rotary shaft 42 is rotated so that the pin 70 moves out of the indent 60 defined by the capture portion 48, the torsion spring 54' moves the pin 70 clear of the capture portion 48 so that the rotary shaft 42 is now able to be driven freely without further resistance or interference from the locking assembly 34.

Figure 11:
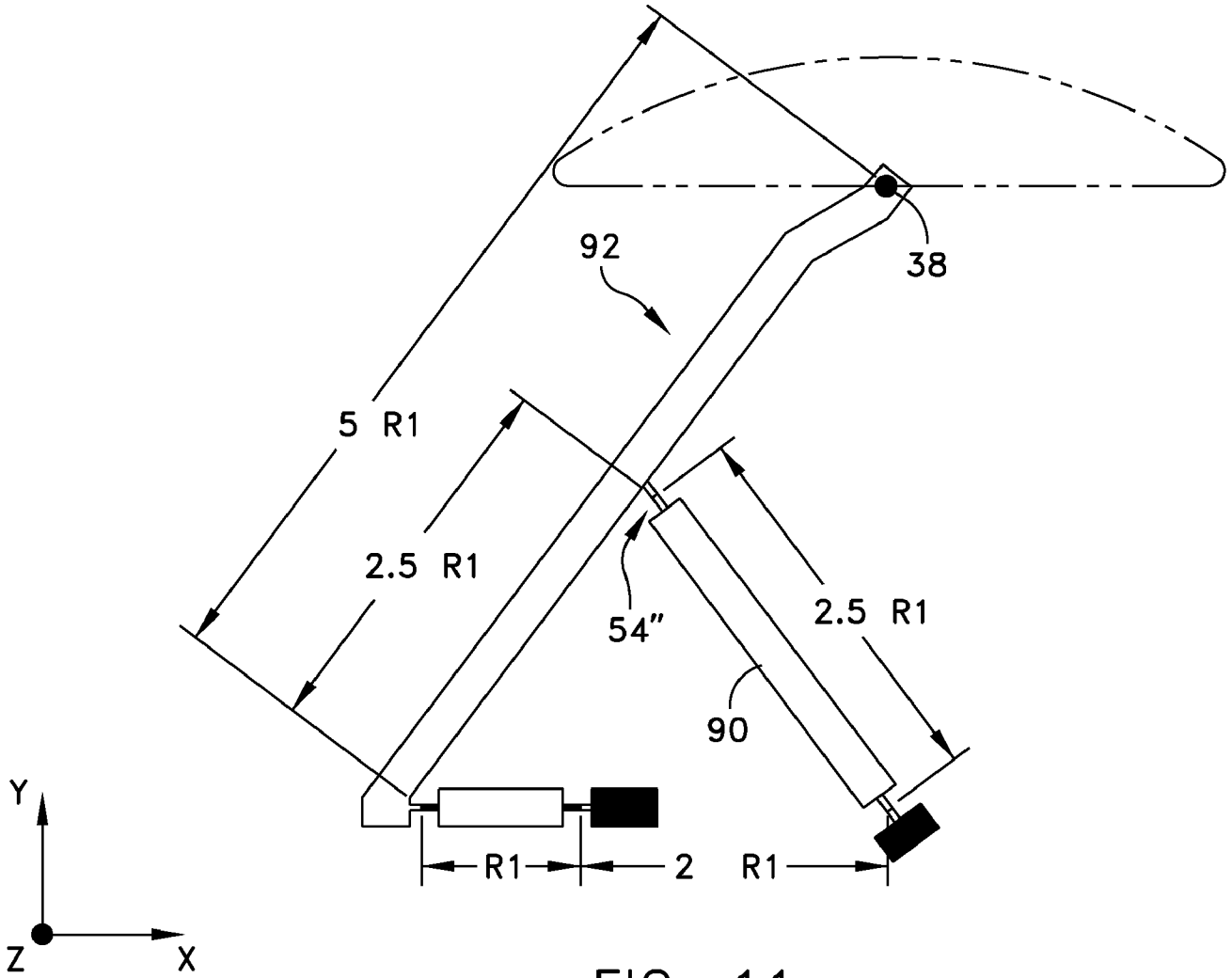
FIG. 11 is a bottom view of the improved locking assembly of FIG. 2 with yet an alternative spring mechanism.

FIG. 11 shows another configuration for the locking assembly 34 which is another alternative to that shown above in connection with FIG. 7. In the configuration of FIG. 11, the locking assembly 34 includes a compliant mechanism having compliant material sections 54" which are integrated with the stronger/stiffer sections 90 and a pin 70 to form a unitary body 92 which affixes to the base 40.

In a manner similar to that of the compression spring 54 and the torsion spring 54', the compliant material sections 54" are constructed and arranged to bias the pin 70 against a corresponding capture portion 48. That is, the compliant material sections 54" are constructed and arranged to apply force on the pin 70 while the pin 70 abuts the indent 60 of the capture portion 48. Accordingly, the pin 70 applies retention force which holds the rotary shaft substantially in place. However, once the rotary shaft 42 is rotated so that the pin 70 moves out of the indent 60 defined by the capture portion 48, the compliant material sections 54" move the pin 70 clear of the capture portion 48 allowing the rotary shaft 42 to be driven unhindered by the locking assembly 34.

The configuration of FIG. 11 is similar to a Hoeken mechanism due to its linear motion as shown in FIG. 11. Along these lines, the dimension R1 can be any length (e.g., 0.1 inches) with the various portions of the compliant mechanism scaling proportionately. Other compliant mechanisms are also suitable for use as well.

As described above, embodiments of the invention involve capture of a rotary shaft 42 using a detention mechanism 44 (e.g., spring-loaded pins 70 resting within indents 60 on the shaft 42). While the rotary shaft 42 is in a non-operating state, the detention mechanism 44 is capable of robustly and reliably holding the rotary shaft 42 in a fixed position, i.e., a locked state. To unlock the rotary shaft 42 from the detention mechanism 44, the rotary shaft 42 rotates until the detention mechanism 44 lets go of the rotary shaft 42. In the context of a guidable projectile 20, the rotary shaft 42 may be the rotor of an electric motor 30 which is constructed and arranged to control orientation of a control surface member 24 (e.g., a fin) after deployment or arming. Prior to deployment, the detention mechanism holds the rotor of the electric motor 30 in place to prevent stresses on the control surface from overstressing or damaging the rotor and its connecting linkage 32. To unlock the rotor from an initial locked position, a user simply directs the motor 30 to turn the rotor out of its locked position until the detention mechanism lets go of the rotor. The motor is then able to freely steer the control surface member 24. Accordingly, it will be appreciated that there is no need to have separate electronic circuitry solely responsible for controlling the locking/unlocking feature. Rather, the same guidance system 26 which steers the control surface member 24 after launch can be used to control locking/unlocking of the rotor.

While various embodiments of the invention have been particularly shown and described, it will be understood by those skilled in the art that various changes in form and details may be made therein without departing from the spirit and scope of the invention as defined by the appended claims.

For example, the capture portions 48 were described above as residing on the rotary shaft 42 and the retainers 52 were described above as residing on the base 40 by way of example only. In alternative arrangements, the capture portions 48 reside on the base 40, and the retainers 52 residing on the rotary shaft 42.

Additionally, the locking assemblies 34 were described above as locking a rotary shaft 42 that drives a control surface member 24 by way of example only. The locking assemblies 34 are capable of locking other types of rotary shafts 42 as well such as actuator shafts that control fin ejection from the inside of the body, axles of vehicles, etc. The locking assemblies 34 are suitable for use in a variety of other applications which involve initially holding a rotary shaft 42 in place prior to subsequent operation.

What is claimed is:

1. A locking assembly, comprising:

a base;

a rotary shaft which is capable of rotating relative to the base, the rotary shaft having a shaft body, an end face, and a set of capture portions supported on the end face; and a set of detention mechanisms supported by the base, the set of detention mechanisms being arranged to (i) initially apply retention force to the set of capture portions to provide resistance against rotation of the rotary shaft from an initial angular position, and (ii) remove application of the retention force from the set of capture portions in response to an amount of rotational torque on the rotary shaft, the amount of rotational torque on the rotary shaft exceeding a predetermined threshold and being sufficient to substantially rotate the rotary shaft from the initial angular position;

wherein the set of capture portions includes a first capture portion and a second capture portion; and said set of detention mechanisms includes:

a first retainer, a first spring which is arranged to (i) bias the first retainer against the first capture portion when the set of detention mechanisms initially applies the retention force to the set of capture portions, and (ii) no longer bias the first retainer against the first capture portion when the set of detention mechanisms removes application of the retention force from the set of capture portions, a second retainer, and a second spring which is arranged to (i) bias the second retainer against the second capture portion when the set of detention mechanisms initially applies the retention force to the set of capture portions, and (ii) no longer bias the second retainer against the second capture portion when the set of detention mechanisms removes application of the retention force from the set of capture portions.

2. A locking assembly as in claim 1 wherein the shaft body of the rotary shaft defines a central axis about which the rotary shaft is capable of rotating;

wherein the first spring is arranged to bias the first retainer substantially in a first radial direction from the central axis and toward the first capture portion; and wherein the second spring is arranged to bias the second retainer substantially in a second radial direction from the central axis and toward the second capture portion.

3. A locking assembly as in claim 2 wherein the first radial direction is substantially opposite the second radial direction.

4. A locking assembly as in claim 2 wherein the first and second capture portions of the rotary shaft are disposed at an end of the shaft body of the rotary shaft.

5. A locking assembly as in claim 2 wherein the first capture portion of the rotary shaft defines first indent;

wherein the first retainer includes a first pin which is arranged to rest within the first indent defined by the first capture portion when the set of detention mechanisms initially applies the retention force to the set of capture portions;

wherein the second capture portion of the rotary shaft defines second indent; and wherein the second retainer includes a second pin which is arranged to rest within the second indent defined by the second capture portion when the set of detention mechanisms initially applies the retention force to the set of capture portions.

6. A locking assembly as in claim 5 wherein the first and second indents, which are defined by the first and second capture portions, face toward each other and toward the central axis.

7. A locking assembly as in claim 5 wherein the first retainer further includes a first retainer body and a first neck which interconnects the first retainer body to the first pin;

wherein the first spring is a first compression spring which is arranged to provide spring force on the first retainer body in the first radial direction when the first compression spring is compressed between the base and the first retainer body;

wherein the second retainer further includes a second retainer body and a second neck which interconnects the second retainer body to the second pin; and wherein the second spring is a second compression spring which is arranged to provide spring force on the second retainer body in the second radial direction when the second compression spring is compressed between the base and the second retainer body.

8. A locking assembly as in claim 5 wherein the first spring is a first torsion spring having one end affixed to the base and another end attached to the first pin; and wherein the second spring is a second torsion spring having one end affixed to the base and another end attached to the second pin.

9. A locking assembly as in claim 5 wherein the first spring is a first compliant material section which is integrated with the first pin to form a first unitary body affixed to the base; and wherein the second spring is a second compliant material section which is integrated with the second pin to form a second unitary body affixed to the base.

10. A locking assembly as in claim 1 wherein the rotary shaft is a motor shaft; wherein the base is a motor housing; and wherein the motor shaft and the motor housing form at least a portion of a motor.

11. A locking assembly as in claim 10 wherein the motor is an electric DC motor which is arranged to provide the amount of rotational torque exceeding the predetermined threshold.

12. A guidable projectile, comprising:

a main projectile body;

a control surface member; and a locking assembly coupled to the main projectile body and the control surface member, the locking assembly including:

a base supported by the main projectile body, a rotary shaft arranged to control movement of the control surface member relative to the main projectile body, the rotary shaft being capable of rotating relative to the base, the rotary shaft having a shaft body and a set of capture portions supported by the shaft body, a set of detention mechanisms supported by the base, the set of detention mechanisms being arranged to (i) initially apply retention force to the set of capture portions to provide resistance against rotation of the rotary shaft from an initial angular position, and (ii) remove application of the retention force from the set of capture portions in response to an amount of rotational torque on the rotary shaft, the amount of rotational torque on the rotary shaft exceeding a predetermined threshold and being sufficient to substantially rotate the rotary shaft from the initial angular position;

wherein the set of capture portions includes a first capture portion and a second capture portion; and wherein the set of detention mechanisms includes:

a first retainer, a first spring which is arranged to (i) bias the first retainer against the first capture portion when the set of detention mechanisms initially applies the retention force to the set of capture portions, and (ii) no longer bias the first retainer against the first capture portion when the set of detention mechanisms removes application of the retention force from the set of capture portions, a second retainer, and a second spring which is arranged to (i) bias the second retainer against the second capture portion when the set of detention mechanisms initially applies the retention force to the set of capture portions, and (ii) no longer bias the second retainer against the second capture portion when the set of detention mechanisms removes application of the retention force from the set of capture portions.

13. A guidable projectile as in claim 12 wherein the shaft body of the rotary shaft defines a central axis about which the rotary shaft is capable of rotating;

wherein the first spring is arranged to bias the first retainer substantially in a first radial direction from the central axis and toward the first capture portion; and wherein the second spring is arranged to bias the second retainer substantially in a second radial direction from the central axis and toward the second capture portion.

14. A guidable projectile as in claim 12 wherein the rotary shaft of the locking assembly is a motor shaft;

wherein the base of the locking assembly is a motor housing; and wherein the motor shaft and the motor housing form at least a portion of an electric motor which is arranged to (i) provide the amount of rotational torque exceeding the predetermined threshold, and (ii) control trajectory of the guidable projectile following launch of the guidable projectile.

* * * * *